United States Patent [19]

Narasimhan et al.

[11] 4,270,496

[45] Jun. 2, 1981

[54] WELDED ARTICLE AND METHOD OF MAKING SAME

[75] Inventors: Sundaram L. Narasimhan; Jay M. Larson, both of Marshall, Mich.

[73] Assignee: Eaton Corporation, Cleveland, Ohio

[21] Appl. No.: 973,058

[22] Filed: Dec. 26, 1978

[51] Int. Cl.[3] ..... F01L 1/14

[52] U.S. Cl. ..... 123/90.51

[58] Field of Search ..... 29/156.7 B; 123/90.51

[56] References Cited

U.S. PATENT DOCUMENTS

| | | | |
|---|---|---|---|
| 2,247,278 | 6/1941 | Daisley | 29/156.7 B |
| 2,963,011 | 12/1960 | Davis et al. | 123/90.51 |

*Primary Examiner*—Harry N. Haroian

*Attorney, Agent, or Firm*—R. J. McCloskey; E. C. Crist; R. A. Johnston

[57] ABSTRACT

A cam follower having a two-piece composite laser welded configuration is disclosed and comprises a solid and alternatively thin wall tubular base (16) portion formed of mild steel and a thin-disc reaction portion (18) having a hardened, wear resistant outer surface portion (50). The reaction portion is joined to the base portion by laser welding which results in a weld zone (54) comprised of a fusion zone (56) bounded on either side thereof by heat affected zones (58) having relatively narrow transverse thicknesses. A method of laser welding the hardened reaction portion to the mild steel base portion is also disclosed.

20 Claims, 8 Drawing Figures

WELDED ARTICLE AND METHOD OF MAKING SAME

BACKGROUND OF THE INVENTION

In one aspect, the present invention relates to force transmitting members and more particularly to cam followers for use in conjunction with internal combustion engines.

In another aspect the invention relates to a member formed by welding together materials having significantly different carbon and other alloy percentage compositions and also to methods of welding heat treated hardenable members to mild steel members.

DESCRIPTION OF THE PRIOR ART

Cam followers used in conjunction with hydraulic lash adjusters require a hard wear resistant surface for contacting the cam and have heretofore been formed of a solid slug of cast iron which is thereafter subject to numerous precision machining and heat treating operations to arrive at a finished component. Tappets for internal combustion engines are made of wear resistant materials such as heat treated cast irons, hardened medium to high carbon steels, or surface hardened low carbon steels. Making tappet bodies by casting solid pieces demands stringent and skillful control of casting procedures to obtain the necessary variation in properties extending from a hard wear surface at one end to a relatively soft machinable core.

Solid blanks of wrought, medium carbon steel are also used, but require considerable machining involving higher costs and longer production time. It is also known to provide a wear resistant cam follower by surface hardening low carbon steel machined from solid stock.

There has arisen a need for reducing the weight of all engine components in today's automotive vehicles. As a result of this need, it has been sought to provide an alternative, low weight cam follower design having a wear resistant surface which can be manufactured at reduced costs and which will withstand extended cyclic loading without fatigue failure in an internal combustion engine environment.

SUMMARY OF THE INVENTION

The present invention provides a lightweight, low cost, cam follower having a two-piece construction comprising a lower base portion solid in one embodiment and having in another embodiment a thin walled, tubular base member formed of mild steel with a thin walled, disc shaped reaction member laser welded to one end thereof. The reaction member is fabricated from either a high carbon or heat treatable alloy steel, a cast iron material, or a composite non-ferrous alloy having surface wear properties compatible with the cam material to be contacted.

The laser welding method of the invention produces a weld zone having a transverse thickness substantially less than the wall thickness of the reaction member, thereby minimizing distortion and residual stresses inherent in weldments made by conventional welding techniques.

A further advantage of the laser welding method is that a thin walled, hardened reaction member having a high carbon content can be successfully metallurgically joined to a low carbon steel body without adversely affecting to any substantial degree the physical and mechanical properties of the base materials adjacent the weld zone.

The invention method further utilizes simple fixturing with the resultant advantage of rapid part handling and low equipment costs.

Another advantage of the method of laser welding is the improved reproducibility of quality welds which maintains a higher level of weld strength, and longer fatigue life.

A further advantage of the laser welding method is that a small heat affected zone on either side of a fusion product zone enables the use of a reaction member heat treated prior to welding without adversely affecting its wear resistant properties.

DETAILED DESCRIPTION

Figure 1:
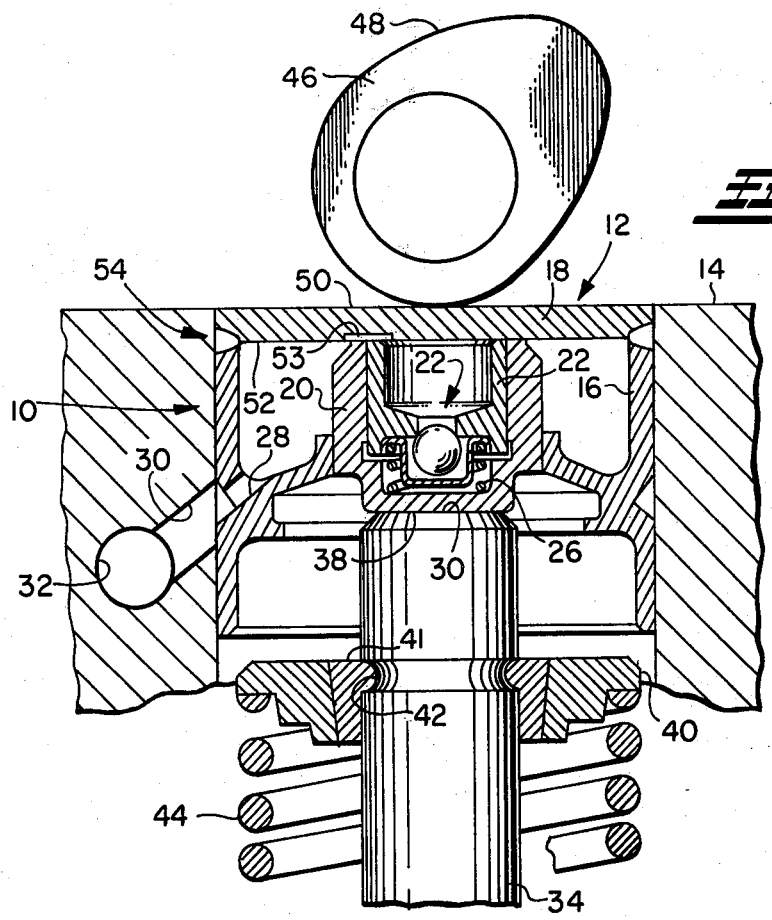
FIG. 1 is a cross sectional view of the invention shown in association with a direct acting hydraulic valve lifter as mounted in an internal combustion engine.

Referring now to FIG. 1, there is shown generally by reference numeral 10 a hydraulic lash adjuster which includes a cam follower 12 of two piece construction slidably received in an engine cylinder head 14. The cam follower of the present invention is comprised of a mild steel tubular base member 16 laser welded to a disc shaped reaction member 18 formed of either a suitable heat treatable cast iron, high carbon steel, or non-ferrous heat treatable alloy. The laser welding method of the present invention and will be described subsequently in greater detail as will be the structure of the welded connection between members 16 and 18.

The hydraulic lash adjuster 10 illustrates the invention as embodied in a force transmitting application and the manner in which the physical properties of cam follower 12 are adaptable thereto. Slidably mounted within cam follower 12 is an outer plunger member 20, an inner plunger member 22, and a one-way check valve assembly, indicated generally by reference numeral 24, mounted therebetween. A compression spring 26 is mounted intermediate outer plunger 20 and inner plunger 22. A fluid passageway 28 is formed through the wall of tubular base member 16 and is in fluid communication with a passageway 30 in engine cylinder head 14 and functions to convey pressurized engine fluid from an oil gallery 32 in cylinder head 14. The upper portion of a valve stem 34 is shown with its top surface 36 engaging a reaction surface 38 formed on outer plunger 20. A washer 40 is attached to valve stem 34 and retained thereto by a keeper or retaining ring 41 seated in a circumferential groove 42 near the top end of the valve stem. As is well known in engine design practice the valve spring 44 biases valve stem 34 upwardly into engagement with hydraulic lifter 10 which in turn reacts against an engine cam 46 having a cam profile 48. Cam profile 48 is engageable with a wear surface 50 located on the outer surface of reaction member 18.

A lower surface portion 52 of reaction member 18 is engageable with the top end of inner plunger 22 and notch 54 is formed into lower surface 52 and permits fluid communication from oil gallery 32, through passageways 30 and 28, and into the space defined by the internal walls of inner plunger 22. The lash adjuster described above functions to remove lash or clearance between cam profile 48 and the top surface of valve stem 36 during engine operation by permitting fluid to flow past one-way ball valve 24 in response to relative movement of inner plunger 22 and outer plunger 20 which can occur during cam rotation during contact with the base circle portion of profile 48 whereupon the fluid which flowed past one-way ball valve 24 is trapped in the adjuster, thus continuously removing lash from the valve train. In the environment described above surface 50 must have wear resistant properties not possessed by mild carbon steel. Therefore, the material chosen for member 18 must be capable of withstanding the continuous sliding movement of cam 46 and the normal load exerted thereon from inertial and spring forces. Since the loading and wear demands placed upon tubular base section 16 are substantially less severe, the base can be fabricated from a low carbon steel.

The unique, composite structure of cam follower 12 is particularly suited to an application of the type described above due to its substantially lower manufacturing cost and its equivalent functional capabilities as compared to cam follower configurations of the solid one-piece type.

Figure 2:
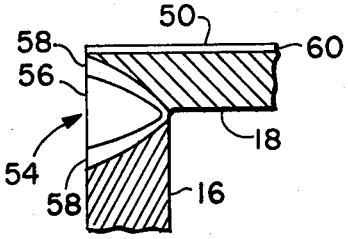
FIG. 2 is an enlarged cross sectional view of the invention cam follower which pictorially illustrates a fusion product zone and a heat affected zone on either side thereof as produced by a laser welding method according to the invention.
Figure 3:
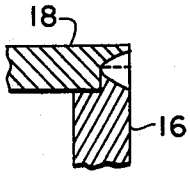
FIGS. 3–7 illustrate pictorially alternate configurations of mating surfaces for the base and reaction members.
Figure 4:
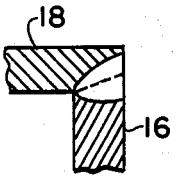
Figure 5:
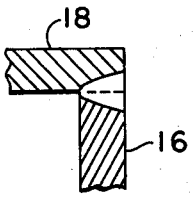
Figure 6:
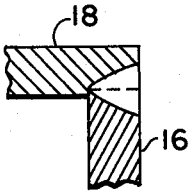
Figure 7:
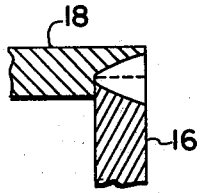

Attention is directed to FIG. 2 which shows an enlarged pictorial representation of the structural features of the two-piece cam follower 12. Reaction member 18 is joined to lower tubular base member 16 by means of a laser welded connection represented generally by a weld zone 54. Weld zone 54 is comprised of a central fusion-produced zone 56 characterized by a substantially uniform metallurgical composition resulting from the alloy constituents present in members 16 and 18. Adjacent each side of fusion product zone 56 are layers 58 which represent a heat effected zone each having a metallurgical composition characterized by a gradual change in microstructure from that defined by fusion product zone 56 to that corresponding respectively to the structure of members 16 and 18. Reaction member 18 might include a wear resistant heat treated zone 60 located on the external surface thereof and which defines wear surface 50. This zone 60 will be present if reaction member 18 is formed of a case hardened material as discussed in detail below.

A significant structural feature of weld zone 54 is that the transverse thicknesses of heat affected zone 58 are substantially thinner than fusion product zone 56. In the presently preferred practice of the invention, the width of weld zone 54 is maintained less than twice the thickness of reaction member 18 to avoid interferring with heat treated zone 60 and wear surface 50. A heat effected zone of substantially reduced thickness enables the use of a reaction member having a thickness in the range of 0.060 inch (1.52 mm) to 0.125 inch (3.18 mm) and heat treated on one side to be metallurgically joined to a thin walled tubular base member without affecting the microstructure of the wear surface. In the presently preferred form of the invention the wall thickness of member 18 is in the range of 0.050 inch (1.27 mm) to 0.100 inch (2.54 mm). The material thicknesses defined above provide suitable base members having diameters in the range of 1.00 inch (2.54 mm) to 2.00 inches (5.08 mm). It will be recognized by those skilled in the art that the specific dimensions of members 16 and 18 will vary according to strength requirements dictated by the specific application.

A further advantage of the above described weld zone structure is that tubular base member 18 can be formed of a low cost, mild steel suitable for cold forming, as for example, an iron-carbon alloy having a carbon content of about 0.05% to about 0.20%.

In the present practice of the invention material found satisfactory for reaction member 18 are the hardenable medium to high carbon steels, for example, SAE grades 5120, 8620, 1060, 52100. Also, a suitable cast iron of the hardenable or chill type used commonly for tappets, or hardenable, non-ferrous metallic composite materials may be employed.

FIGS. 3–7 illustrate alternate constructions of reaction member 18 and base member 16 with the mating surfaces prior to welding represented by the dashed lines of each figure. The particular configuration of the mating surfaces of the base member and the reaction member will, however, be dictated by the nature of fixturing and material handling equipment associated with the laser welding method, and/or strength requirements.

Figure 8:
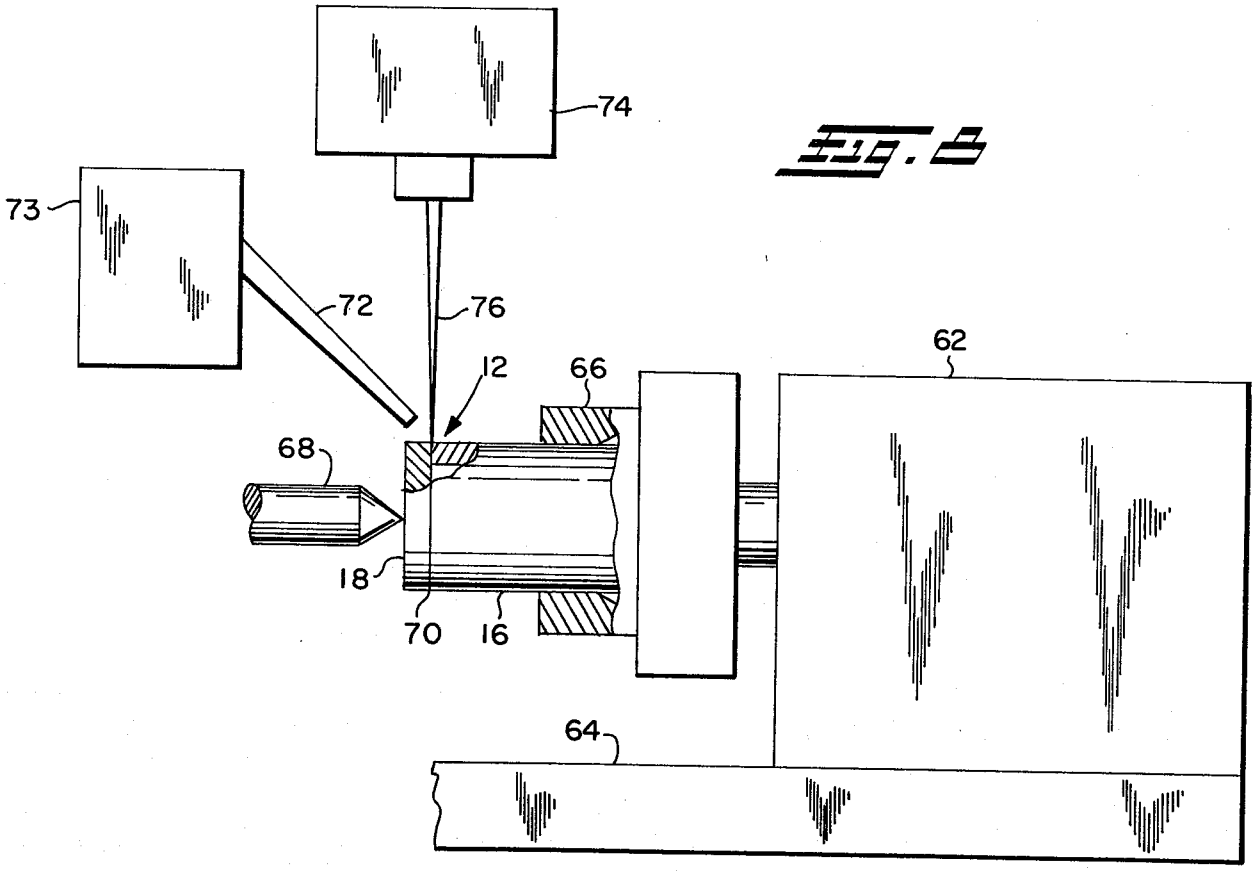
FIG. 8 is a schematic illustration showing the basic equipment arrangement for producing a laser welded connection according to the invention.

Referring to FIG. 8, there is shown schematically equipment required for producing a laser welded connection as described above according to the method of the invention. The equipment includes a variable speed drive 62 selectively positionable along a traverse table 64. An adjustable chuck arrangement 66 is connected to the output of drive 62 and has secured therein tubular base member 16. Reaction member 18 is positioned and secured against the end face of tubular base 16 and frictionally held in place by an axial force exerted thereon by a live center 68 which rotates along with chuck 66. The amount of axial force exerted against reaction member 18 by the live center should only be great enough to avoid slipping relative to base member 16 as the chuck rotates. An interface 70 is defined by the mating surface of members 16 and 18 and in the preferred practice of the invention the maximum overlap of the peripheral surfaces thereof should be limited to a small fraction of the thickness of the reaction member and preferably the surfaces should match. A flow of inert gas, preferably helium, argon, or a mixture thereof, is supplied through a nozzle 72 from a supply 73 so that interface 70 and the peripheral surface areas immediately adjacent can be covered and shielded by a protective gas blanket.

A high power $CO_2$ laser 74 or an equivalent laser power source capable of emitting approximately 1500 watts of laser power is positioned adjacent traverse table 64 to direct a laser beam 76 through the axis of rotation of chuck 66.

With continued reference to FIG. 8, the method of laser welding the cam follower 12 will now be described. Tubular base 16 is first inserted into chuck 66 and reaction member 18 is aligned thereagainst with minimum peripheral overlap at interface 70 as described above and held thereagainst by live center 68. The output R.P.M. of variable speed drive 62 is set to obtain the desired peripheral speed at the weld interface of approximately; in the present practice of the invention a peripheral speed of 0.75–1.25 inches per second has been found satisfactory. A cover of inert gas is then provided over interface 70 at a point where laser beam 76 will eventually be focused in order to protect the molten weld zone formed by laser energy from the damaging effects of oxidation. Laser source 74 is then turned on and run at a continuous pulsed mode and at a power sufficient to produce a visible reference flash marking on the surface of the rotating part. In the present practice of the invention a pulse rate of about one pulse per second and a maximum power of 50 watts have been found satisfactory. For example, it has been found that focusing the beam at a point 0.030 inches (0.762) mm beneath the surface increases weld penetration by 0.0050.010 inches (0.27 to 0.254 mm). Traverse table 64 is then quickly positioned under laser source 74 until the visible flashes on the rotating part occur directly over interface 70. A suitable magnifying device such as a low power microscope, not shown, may be used as an aid in aligning the beam with the interface. In the preferred practice of the invention method, the angle of incidence measured from a direction normal to the surface at the interface should not deviate beyond 20 degrees. Deviations beyond 20 degrees might result in hazardous reflections and a reduction in the effective power available for welding.

Focusing lenses, not shown, having focal lengths in the range of 2½, to 5 inches are preferably employed and adjusted to focus the laser beam at the surface of interface 70. It has been found that increased penetration can be achieved by focusing the beam at a point slightly beneath the surface of interface 70 which increases weld penetration (0.127 mm) -(0.254) inches. Under focusing beyond a depth of 0.01 inch (0.254 mm) should be avoided. After the beam has been focused in line with the interface, the laser generator is then turned off. Drive 62 continues to rotate at the desired R.P.M.

Laser generator 74 is then switched on to a continuous operating mode for producing an uninterrupted laser beam as opposed to the pulsed mode defined above for focusing and aligning the beam. Start-up power is set at a low value and is increased gradually to full weld power in a fraction of a second. Start-up power of 100 watts increased to 1400 watts within about one-fourth to one-half second has been found satisfactory. It is essential that start up power be relatively low in order to prevent evaporation of the workpiece which would occur if full power were provided at start up since there would be insufficient time for the base material in both reaction member 18 and tubular base 16 to absorb the generated heat. As the power is increased from 100 to 1400 watts, a molten front forms beneath the beam and advances through the interface as the workpiece is traversed under the beam resulting in uniform heat distribution around the weld. Power is maintained at the 1400 watt level until the entire interface is welded. Dwell time at maximum power can be calculated by dividing the circumference at the interface by the surface speed at the interface relative to the laser beam. For example, a one-inch diameter at the interface and a speed of one inch per second requires an approximate weld time at maximum power of 3.16 seconds. Upon completion of one complete revolution at maximum power, the power is decreased from in the same manner as start-up. The laser generator is then shut off upon completion of the ramp-down trace of welding, thus finishing the welding cycle. Depth of penetration given the welding conditions described above is approximately 0.06–0.08 inch (1.52–2.03 mm). Penetration can be varied by adjusting laser beam power and traversing speed.

The laser welding method disclosed above is directed to a workpiece assembly requiring a continuous circumferential weld having uniform properties throughout. The laser method described would, however, be uniquely applicable to weldments requiring that linear interfaces or even non-linear interfaces be metallurgically joined together. In linear welding applications all of the above method steps are repeated. It will be understood, however, that in linear welding the last step, the ramp-down power step, is eliminated since it is not required to blend the end of the weld zone into the starting point as in the case of a continuous cirumferential weld.

We claim:

1. A cam follower for an internal combustion engine, comprising:

(a) a base portion formed of an iron-carbon alloy having a carbon content in the range of about 0.05% to about 0.20%;

(b) a reaction portion having a wear resistant outer surface, said reation portion formed of a ferrous-carbon alloy having a carbon content in the range of about 0.60% to about 1.00%; and (c) a weld zone joining said base and reaction portions, said weld zone including, (i) a fusion product zone in which portions of said base and reaction portion are alloyed in a first composition, (ii) a first heat effected zone in said base portion and adjacent said fusion product zone, said first heat effected zone characterized by a second alloy composition, (iii) a second heat effected zone intermediate said reaction portion and said fusion product zone and characterized by a third alloy composition, said first and second heat effected zones having a transverse thickness substantially less than the width of said fusion product zone.

2. The cam follower as defined in claim 1 wherein, (a) said reaction portion has a generally thin plate configuration; and (b) said weld zone has a maximum width less than twice the thickness of said reaction portion.

3. The cam follower as defined in claim 1 wherein, (a) said base portion has a tubular configuration with a wall thickness in the range of 0.05 inch (1.27 mm) to 0.11 inch (2.54 mm); and (b) said reaction portion has a thickness in the range of approximately 0.06 inch (1.52 mm) to 0.125 inch (3.18 mm).

4. A cam follower for an internal combustion engine, comprising:

(a) a base portion formed of an iron-carbon alloy having a carbon content in the range of about 0.05% to about 0.20%;

(b) a reaction portion having a wear resistant outer surface, said reaction portion formed of a material selected from the group consisting of an iron-carbon alloy having a carbon content in the range of about 0.60 to about 1.00%, an iron-carbon alloy having a carbon content in the range of about 0.20% to about 0.50%, an iron-carbon alloy having a carbon content in the range of about 2.50% to about 3.50%, or a composite wear resistant alloy having a non-ferrous, metallic composition;

(c) a weld zone joining said base and reaction portions, said weld zone including,
(i) a fusion product zone in which portions of said base and reaction portion are alloyed in a first composition,
(ii) a first heat effected zone in said base portion and adjacent said fusion product zone, said first heat effected zone characterized by a second alloy composition,
(iii) a second heat effected zone intermediate said reaction portion and said fusion product zone and characterized by a third alloy composition, said first and second heat effected zones having a transverse thickness substantially less than the width of said fusion product zone.

5. The cam follower as defined in claim 4 wherein,
(a) said reaction portion has a generally thin plate configuration; and
(b) said weld zone has a maximum width less than twice the thickness of said reaction portion.

6. The cam follower as defined in claim 4 wherein,
(a) said base portion has a tubular configuration with a wall thickness in the range of 0.05 inch (1.27 mm) to 0.11 inch (2.54 mm); and
(b) said reaction portion has a thickness in the range of approximately 0.06 inch (1.52 mm) to 0.125 inch (3.28 mm).

7. The cam follower as defined in claim 4 wherein said base portion has a tubular configuration.

8. A cam follower for an internal combustion engine, comprising:
(a) a metallic base portion,
(b) a metallic reaction portion having a generally thin plate configuration and an outer surface having a minimum hardness of about 55 on the Rockwell C scale; and
(c) a weld zone joining said base and reaction portions, said weld zone including,
(i) a fusion product zone in which portions of said base and reaction portion are alloyed in a first composition,
(ii) a first heat effected zone in said base portion and adjacent said fusion product zone, said first heat effected zone characterized by a second alloy composition,
(iii) a second heat effected zone intermediate said reaction portion and said fusion product zone and characterized by a third alloy composition, said first and second heat effected zones having a transverse thickness substantially less than the width of said fusion product zone.

9. The cam follower as defined in claim 8 wherein, said weld zone has a maximum width less than twice the thickness of said reaction portion.

10. The cam follower as defined in claim 8 wherein,
(a) said base portion has a tubular configuration with a wall thickness in the range of 0.05 inch (1.27 mm) to 0.11 inch (2.54 mm); and
(b) said reaction portion has a thickness in the range of approximately 0.06 inch (1.52 mm) to 0.125 inch (3.18 mm).

11. The cam follower as defined in claim 8, wherein said base portion has a generally tubular configuration.

12. A cam follower for use in an internal combustion engine comprising:
(a) a metallic base portion formed of a first ferrous metal;
(b) a metallic, generally thin plate reaction portion formed of a composition different from said base portion and having a hardened, wear resistant surface, said surface having a minimum hardness of about 55 on the Rockwell C scale; and
(c) means for connecting said base portion to said reaction portion, said connecting means comprising,
(i) a fusion product zone in which portions of said base and reaction portion are alloyed in a first composition,
(ii) a first heat effected zone in said base portion and adjacent said fusion product zone, said first heat affected zone characterized by a second alloy composition; and
(iii) a second heat affected zone intermediate said reaction portion and said fusion product zone and characterized by a third alloy composition, said first and second heat affected zones having a transverse thickness substantially less than said fusion product zone.

13. The cam follower as defined in claim 12, wherein said reaction portion is formed of a material selected from the group consisting of an iron-carbon alloy having a carbon content in the range of about 0.60% to about 1.00%, an iron-carbon alloy having a carbon content in the range of about 0.20% to 0.50%, or an iron-carbon alloy having a carbon content in the range of about 2.50% to about 3.50%.

14. The cam follower as defined in claim 12, wherein said base portion is formed of an iron-carbon alloy having a carbon content in the range of about 0.05% to 0.20%.

15. A cam follower as defined in claim 12, wherein,
(a) said weld zone has a maximum width less than twice the thickness of said reaction portion.

16. The cam follower as defined in claim 12 wherein,
(a) said base portion has a tubular configuration with a wall thickness in the range of 0.05 inch (1.27 mm) to 0.11 inch (2.54 mm); and
(b) said reaction portion has a thickness in the range of approximately 0.06 inch (1.51 mm) to 0.125 inch (3.18 mm).

17. The cam follower as defined in claim 12 wherein said weld zone includes,
(a) a fusion product zone in which portions of said base and reaction portion are alloyed in a first composition;
(b) a first heat effected zone in said base portion and adjacent said fusion product zone, said first heat effected zone characterized by a second alloy composition; and
(c) a second heat effected zone intermediate said reaction portion and said fusion product zone and characterized by a third alloy composition, said first and second heat effected zones having a transverse thickness substantially less than the width of said fusion product zone.

18. The cam follower defined in claim 12 wherein said base portion has a tubular configuration.

19. A cam follower engageable with a cam surface in internal combustion engine valve gear, comprising:
(a) a metallic base portion,
(b) a metallic reaction portion having a generally thin plate configuration and an outer surface having properties adapted for running engagement with said cam surface; and, (c) a weld zone joining said base and reaction portions, said weld zone including, (i) a fusion product zone in which portions of said base and reaction portion are alloyed in a first composition, (ii) a first heat effected zone in said base portion and adjacent said fusion product zone, said first heat effected zone characterized by a second alloy composition, (iii) a second heat effected zone intermediate said reaction portion and said fusion product zone and characterized by a third alloy composition, said first and second heat effected zones having a transverse thickness substantially less than the width of said fusion product zone.

20. A cam follower for an internal combustion engine, comprising:

(a) a metallic base portion, (b) a reaction portion having a generally thin plate configuration and formed of an iron-carbon alloy having a carbon content in the range of about 0.20% to about 3.50%;

(c) a weld zone joining said base and reaction portions, said weld zone including, (i) a fusion product zone in which portions of said base and reaction portion are alloyed in a first composition, (ii) a first heat effected zone in said base portion and adjacent said fusion product zone, said first heat effected zone characterized by a second alloy composition, (iii) a second heat effected zone intermediate said reaction portion and said fusion product zone and characterized by a third alloy composition, said first and second heat effected zones having a transverse thickness substantially less than the width of said fusion product zone.

* * * * *